US006637973B1

(12) United States Patent
Kim

(10) Patent No.: US 6,637,973 B1
(45) Date of Patent: Oct. 28, 2003

(54) AUTOMOBILE ROAD INDICATING DEVICE BY USING OPTICAL TRANSFER

(76) Inventor: Sug-Bae Kim, Samik New Town Apartment 207-1206, 308-11 Naedang-dong, Seo-gu, Daegu-shi 703-752 (KR)

( * ) Notice: Subject to any disclaimer, the term of this patent is extended or adjusted under 35 U.S.C. 154(b) by 0 days.

(21) Appl. No.: 09/890,125

(22) PCT Filed: Jan. 27, 2000

(86) PCT No.: PCT/KR00/00064

§ 371 (c)(1),
(2), (4) Date: Nov. 7, 2001

(87) PCT Pub. No.: WO00/44990

PCT Pub. Date: Aug. 3, 2000

(30) Foreign Application Priority Data

Jan. 28, 1999 (KR) ..... 99-1185
Jan. 25, 2000 (KR) ..... 2000-2009

(51) Int. Cl.[7] ..... G08G 1/00; E01F 9/00

(52) U.S. Cl. ..... 404/9; 116/63 R; 340/932; 340/942

(58) Field of Search ..... 404/9, 12, 13; 116/63 R; 359/193; 340/932, 942, 332

(56) References Cited

U.S. PATENT DOCUMENTS 3,720,913 A * 3/1973 Bradford ..... 340/928
4,117,457 A * 9/1978 Latta ..... 315/149
4,290,047 A * 9/1981 Latta, Jr. ..... 315/149
4,668,120 A * 5/1987 Roberts ..... 404/12
5,021,715 A 6/1991 Smith et al. ..... 315/159
5,412,381 A * 5/1995 Dicks ..... 340/332
5,680,033 A * 10/1997 Cha ..... 136/244
5,697,690 A * 12/1997 Okuchi et al. ..... 362/459
5,828,298 A * 10/1998 Eagan ..... 340/458

FOREIGN PATENT DOCUMENTS

JP 5-311620 * 11/1993
JP 5-321215 12/1993 ..... E01F/9/06
JP 6-280220 10/1994 ..... E01F/9/00
JP 7-331620 * 12/1995
JP 8-50210 * 2/1996

* cited by examiner

*Primary Examiner*—Gary S. Hartmann
(74) *Attorney, Agent, or Firm*—Fish & Richardson P.C.

(57) ABSTRACT

The present invention relates to an automobile road center line indicating device by using optical transfer including: a light condensing device installed at road center line or border line for condensing light emitted from headlights of an automobile; an optical cable for transferring the light condensed by the light condensing device to a predetermined position ahead from the automobile; and a luminous device for transforming the light transferred along the optical cable into straight-advancing parallel light to notify a driver.

3 Claims, 10 Drawing Sheets

AUTOMOBILE ROAD INDICATING DEVICE BY USING OPTICAL TRANSFER

BACKGROUND OF THE INVENTION

1. Filed of the Invention

The present invention relates to a road indicating device, and more particularly to an automobile road indicating device in which light emitted from an automobile is condensed by convex lens of light condensing means, transferred along an optical cable, transformed into straight advancing parallel light by luminous means installed apart at a predetermined distance and illuminated to a long distance, where light emitted from headlights of a driver's automobile does not reach, thereby effectively securing a visible distance in driving to improve the driver's safety.

2. Description of the Prior Art

In general, along with rapid industrial development there has been a great progress in automobile culture to transport a large quantity of goods produced in a factory to a predetermined place. In addition, there has been an expansion of roads to accommodate an increasing number of automobiles.

Accordingly, there are white lines at a predetermined width for ensuring traffic safety of all sorts of automobiles moving in the same direction on lanes of a road and yellow lines in the middle of the road for distinctively indicating the center of a road and at borderlines of the road.

In addition, if the road is bumpy or narrow, a median strip or guard rail is installed in the middle of the road. Furthermore, a light reflecting apparatus is installed on the median strip or guard rail to reflect the light emitted from the headlights of the automobile, so that a driver safely distinguishes his travelling lane from a center line of the road.

FIG. 1 is a plane view for illustrating a state in which a conventional road indicating light reflecting apparatus is used, and FIG. 2 is a perspective view for illustrating a principle involved with the conventional light reflecting apparatus.

The conventional light reflecting apparatus 4 is mounted with a supporting rod 5 on the median strip 3 on the surface 2 of a road 1 for reflecting the light emitted from the headlights of the automobile.

Furthermore, the light reflecting apparatus 4 has a plurality of parts protruded on the back of a transparent plastic material colored in red or yellow for refracting the light, thereby letting the light reflect back at the same incident angle to enable the driver to safely drive in his travelling lane.

However, there is a problem in the conventional light reflecting apparatus in that, if it is used for a long period of time, sunlight discolors it through a chemical change, significantly lowering its light reflecting rate.

In addition, if the luminous piece is far from an automobile, the light reflecting rate tends to significantly decrease because the luminous intensity is inversely proportional to a square of a distance between the luminous piece and the automobile. In other words, if the distance between the automobile and luminous piece is greater than 50 meters, the quality of the light reflecting apparatus significantly decreases to weaken the road indicating function and lower a driver's ability of safely driving according to his own prediction. Therefore, there is another problem in the conventional light reflecting apparatus in that an automobile may get out of its travelling lane and cause a traffic accident.

Particularly, if the road is very bumpy, the light emitted from the headlights may not illuminate even a few meters or tens of meters ahead. At this time, there is a further problem in the conventional light reflecting apparatus in that light emitted from the headlights of an automobile is not properly reflected by the apparatus installed within the bumpy area to thereby cause a big traffic accident as well as difficulties in driving, because the automobile may gets across the road center line into the next lane on which other cars are travelling to an opposite direction or gets out of a road border line.

SUMMARY OF THE INVENTION

Therefore, it is an object of the present invention to provide an automobile road indicating device in which light emitted from an automobile is condensed by convex lens of light condensing means, transferred along an optical cable, transformed into straight-advancing parallel light by luminous means installed apart at a predetermined distance and illuminated to a long distance, where the light emitted from headlights of a driver's automobile does not reach, thereby effectively securing his visible distance in driving to improve the driver's safety.

In order to accomplish the aforementioned object of the present invention, there is provided a first embodiment of an automobile road center line indicating device by using optical transfer comprising: light condensing means installed at road center line or border line for condensing light emitted from headlights of an automobile; an optical cable for transferring the light condensed by the light condensing means to a predetermined position ahead from the automobile; and luminous means for transforming the light transferred along the optical cable into straight-advancing parallel light to notify a driver.

In addition, there is also provided a second embodiment of the present invention comprising: an integral type case having a fixed piece fastened at the median strip, first and second spaces separated by a diaphragm, first and second hitching jaws formed at its both internal lateral edges and an optical cable installation part penetrated through the center of the diaphragm to a predetermined length; condensing lenses mounted at lens accommodating surface separated by a hitching jaw formed inside the lateral surface of the integral case for condensing light; an optical cable inserted in an installation opening of an optical transfer part of the integral type case and surrounded by a elastically supporting member for transferring the light condensed by the condensing lenses and luminous lenses deposed at a lens accommodating surface separated by a hitching jaw formed in a lateral surface of the integral type case for transforming into straight-advancing parallel light; light transmitting plates deposed in front of the condensing lenses and luminous lenses for protection; and pressingly fixing plates having an optical transfer opening mounted for pressing and fixing the light transmitting plates with fastening screws.

BRIEF DESCRIPTION OF THE DRAWINGS

Objects and aspects of the invention will become apparent from the following description of an embodiment with reference to the accompanying drawings in which.

DETAILED DESCRIPTION OF THE PRESENT INVENTION

Figure 1:
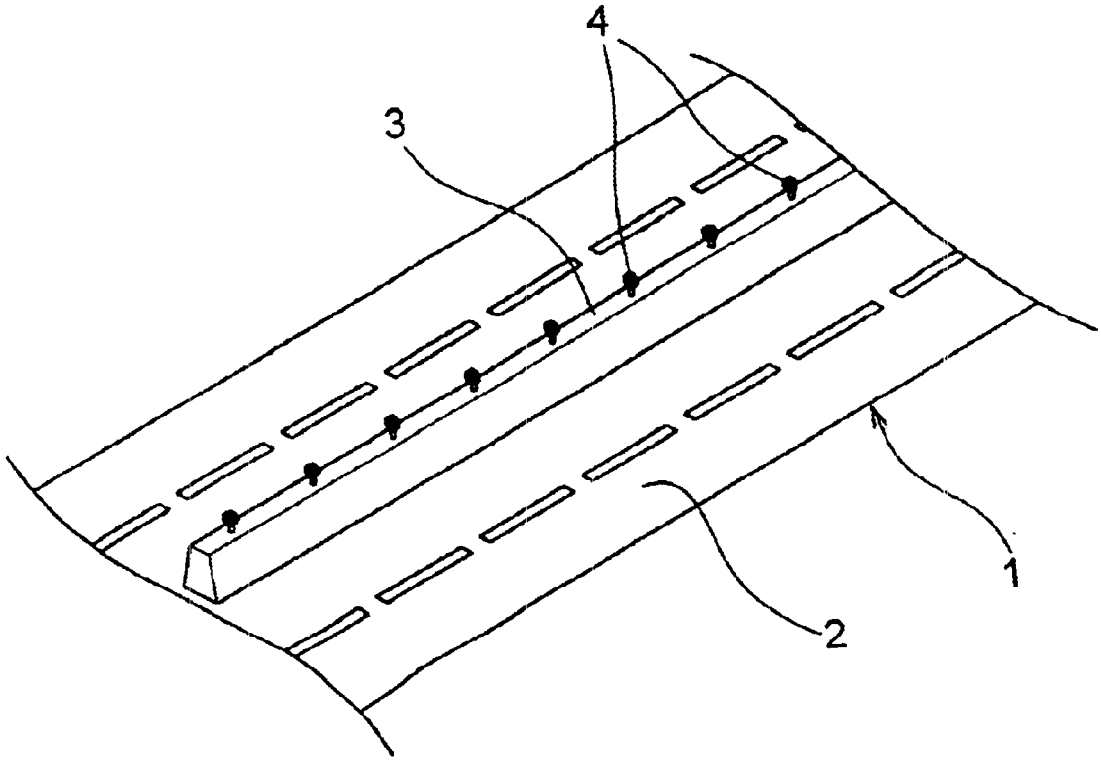
FIG. 1 is a plane view for illustrating a state in which a conventional road indicating light reflecting apparatus is used.
Figure 2:
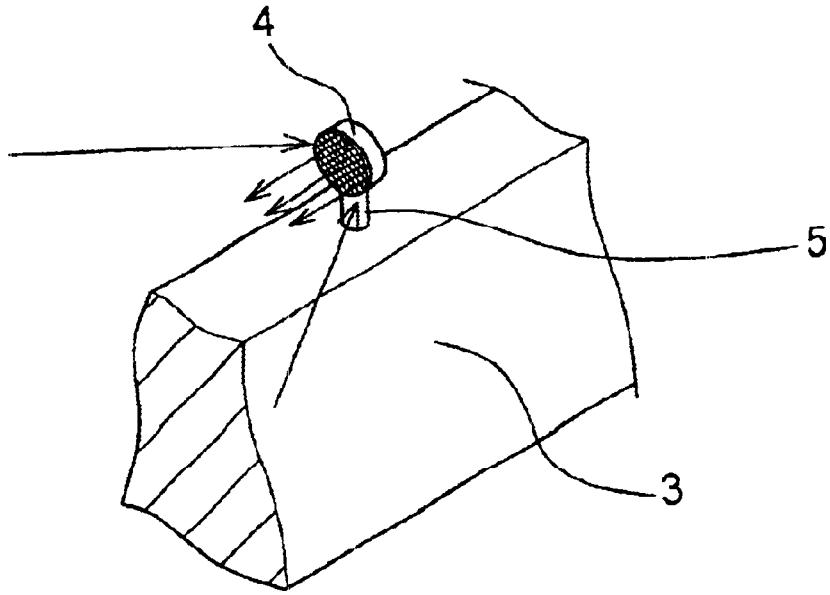
FIG. 2 is a perspective view for illustrating a principle involved with the conventional light reflecting apparatus.

Objects and aspects of the present invention will become apparent from the following detailed description of preferred embodiments with reference to the accompanying drawings. In addition, the same reference numerals will be used for the same parts of the present invention as those of the prior art.

Now, the first embodiment of the present invention will be described in detail in accordance with the accompanying drawings.

Figure 3:
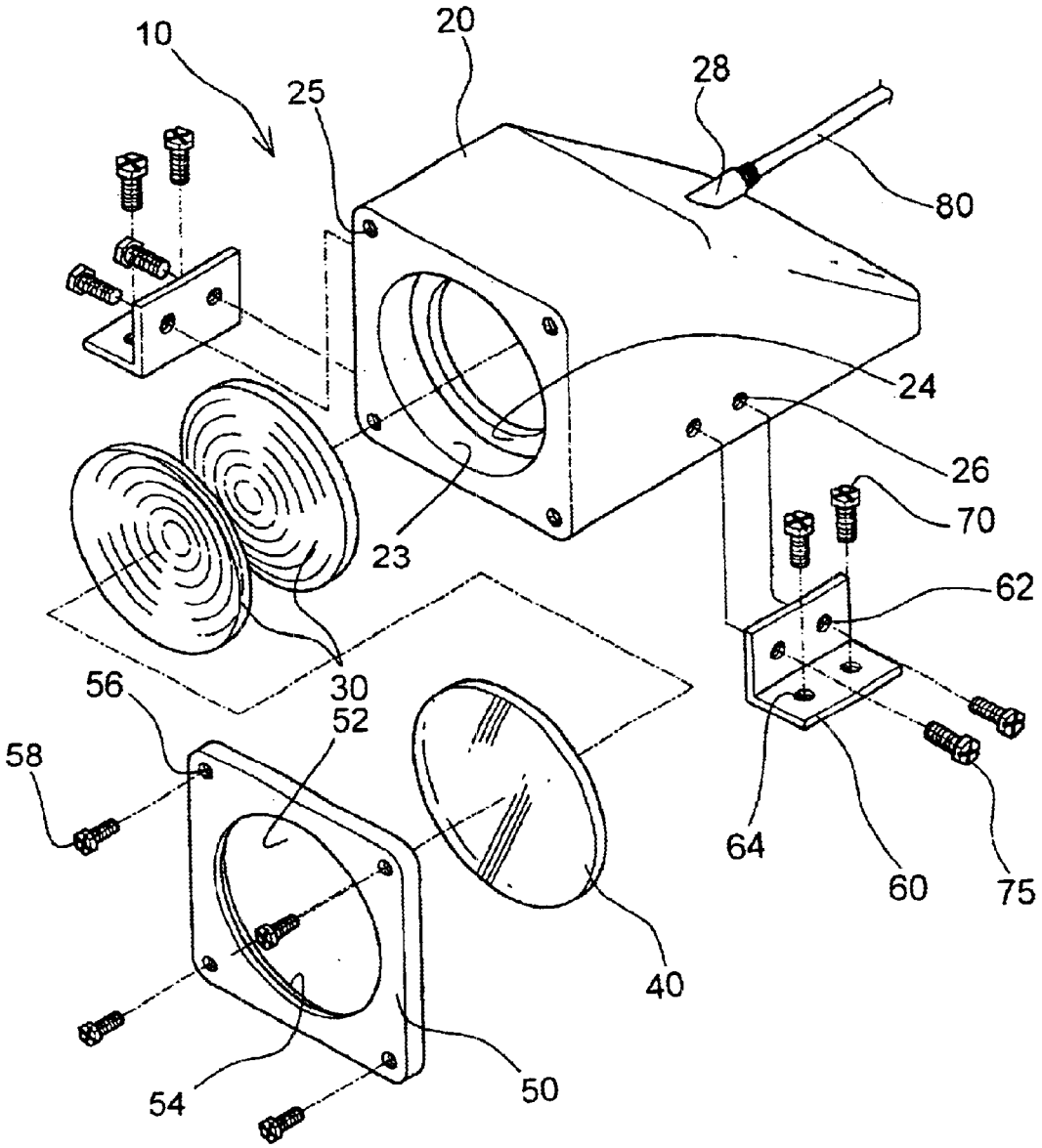
FIG. 3 is an analyzed perspective view for illustrating light condensing means of a road indicating device in accordance with a first embodiment of the present invention.
Figure 4:
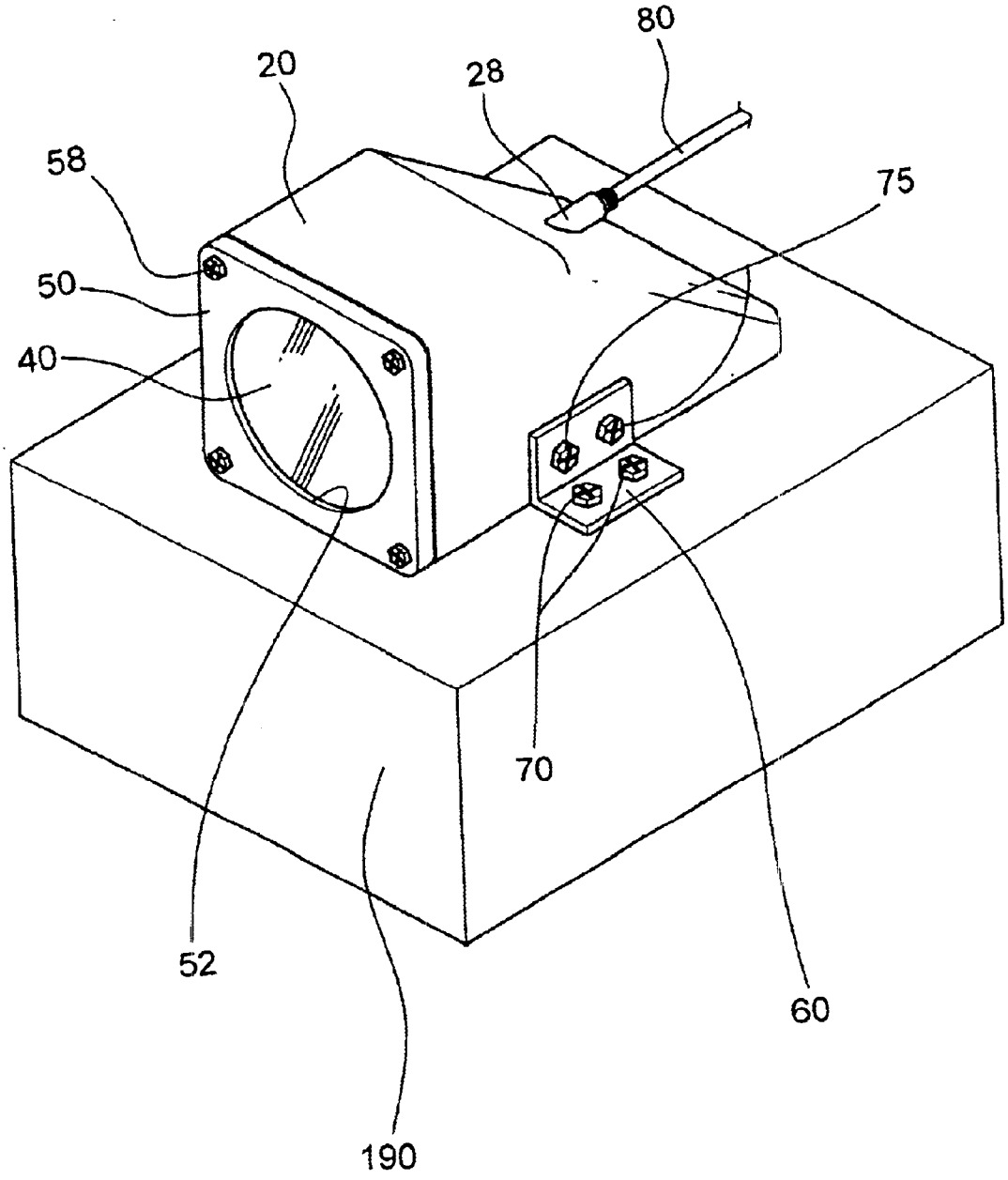
FIG. 4 is a perspective view for illustrating the coupling state of light condensing means of a road indicating device in accordance with the first embodiment of the present invention.
Figure 5:
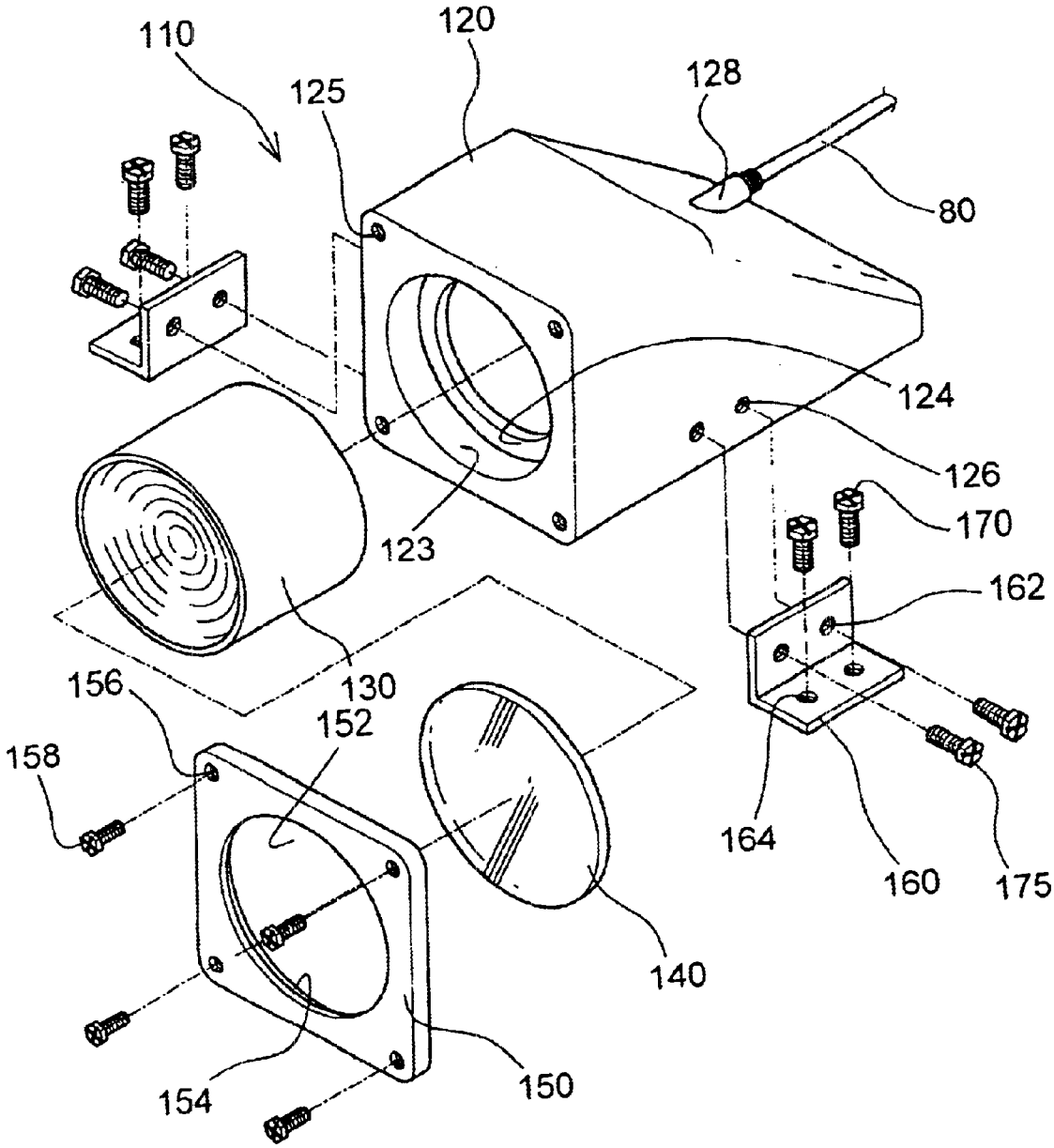
FIG. 5 is an analyzed perspective view for illustrating luminous means of the road indicating device in accordance with the first embodiment of the present invention.
Figure 6:
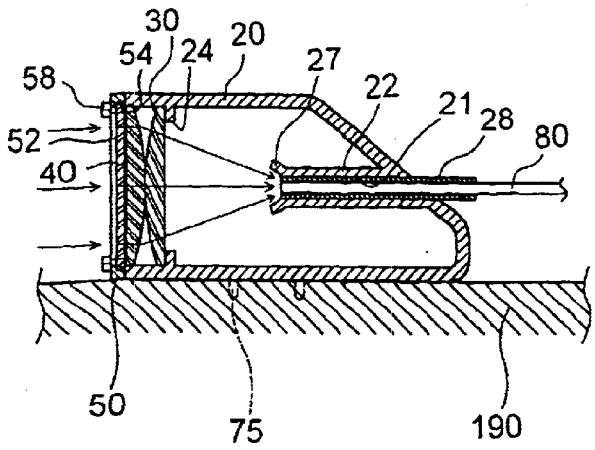
FIG. 6 is a cross-sectional view for illustrating installation of the light condensing means of the road indicating device in accordance with the first embodiment of the present invention.
Figure 7:
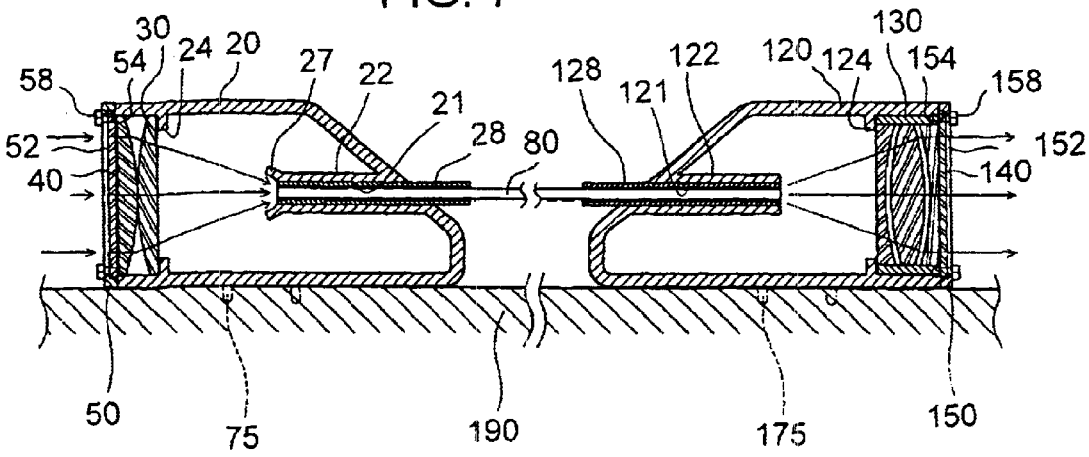
FIG. 7 is a cross-sectional view for illustrating installation of the road indicating device in accordance with the first embodiment of the present invention.

First of all, FIG. 3 is an analyzed perspective view for illustrating light condensing means of a road indicating device, and FIG. 4 is a perspective view for illustrating the coupling state of light condensing means of a road indicating device. FIG. 5 is an analyzed perspective view for illustrating luminous means of the road indicating device, and FIG. 6 is a cross-sectional view for illustrating installation of the light condensing means of the road indicating device. In addition, FIG. 7 is a cross-sectional view for illustrating installation of the road indicating device.

In accordance with the first embodiment of the present invention, the road 200 center line or border line indicating device includes: light condensing means 10 installed at a median strip 190 or border lines for condensing light emitted from headlights of an automobile; an optical cable 80 for transferring the light condensed by the light condensing means 10 to a predetermined position ahead from the automobile 180; and luminous means 110 for transforming the light transferred along the optical cable into straight-advancing parallel light to notify a driver.

Furthermore, as shown in FIGS. 3 and 4, the light condensing means 10 includes: a fixed piece 60 for being fastened at the median strip 190 by bottom fastening screws 70 to be inserted through bottom through-holes 64; a case 20 for being fastened by lateral fastening screws 75 through lateral through-holes 62 formed at an perpendicularly angled part of the fixed piece 60 and, then, lateral through-holes 26 of the case 20 in connection with an optical cable 80 and an optical transfer part 22 in parallel to the center; condensing lenses 30 installed at a lens accommodating surface 23 separated by a hitching jaw 24 of the optical transfer part 22 of the case 20 for transforming the light transferred into straight-advancing parallel light; a light transmitting plate 40 deposed in front of the condensing lenses 30 for protection; and a pressingly fixing plate 50 having an optical transfer opening 52 mounted for pressing and fastening the light transmitting plate 40 through front through-holes 25 of the case 20 with front fastening screws 58 inserted into through-holes 56.

In addition, as shown in FIG. 6, the light condensing means 10 also includes a light condensing part 27 formed for efficiently centering the light condensed at the condensing lenses 30 to the optical cable 80. At this time, the optical cable 80 is pressed into the installation opening 21 of the case 20, being surrounded with elastic supporting member 28 to prevent it from being fallen out by an external impact.

At this time, a double convex lens having plane surfaces on its both sides is used for the condensing lenses 30 for convenient installation. If necessary, a general type single convex lens or another type convex lens (Fresnel lens or the like) may be used for the same purpose.

In order to improve optical transfer efficacy, a plurality of optical cables can be bound and used for the optical cable 80.

Furthermore, as shown in FIG. 5, the luminous means 110 includes: a fixed piece 160 for being fastened at the median strip 190 by bottom fastening screws 170 to be inserted through bottom through-holes 164; a case 120 for being fastened by lateral fastening screws 175 through lateral through-holes 162 formed at an perpendicularly angled part of the fixed piece 160 and lateral through-holes 126 of the case 120 in connection with an optical cable 180 and an optical transfer part 122 being formed in parallel to the center; a luminous lens 130 installed at a lens accommodating surface 123 separated by a hitching jaw 124 of the optical transfer part 122 of the case 120 for transforming the light into straight-advancing parallel light; a light transmitting plate 140 deposed in front of the luminous lens 130 for protection; and a pressingly fixing plate 150 having an optical transfer opening 152 mounted for pressing and fastening the light transmitting plate 140 through front through-holes 125 of the case 120 with front fastening screws 158 to be inserted into through-holes 156.

On the other hand, the luminous lens 130 is constructed in a multiple lens structure with a convex lens being installed in a double concave lens having a convex surface in its internal side. If necessary, a general type single convex lens or another type convex lens (Fresnel lens or the like) may be used for the same purpose.

At this time, the multiple lens structure functions: primarily, multiplying light with the concave lens; secondarily, condensing light with the convex lens; and thirdly, multiplying the condensed light again to thereby transform into straight-advancing parallel light which is unlikely to be widely diffused.

Figure 11:
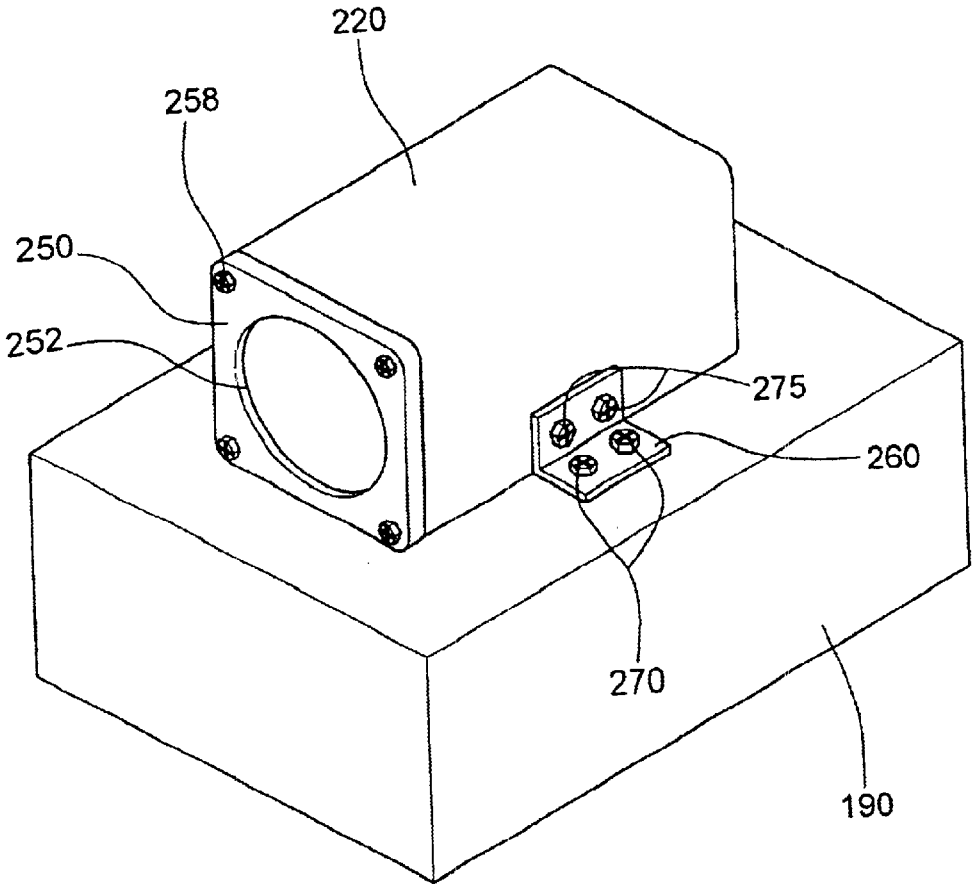
FIG. 11 is a perspective view for illustrating an appearance of a road indicating device in accordance with a second embodiment of the present invention.
Figure 12:
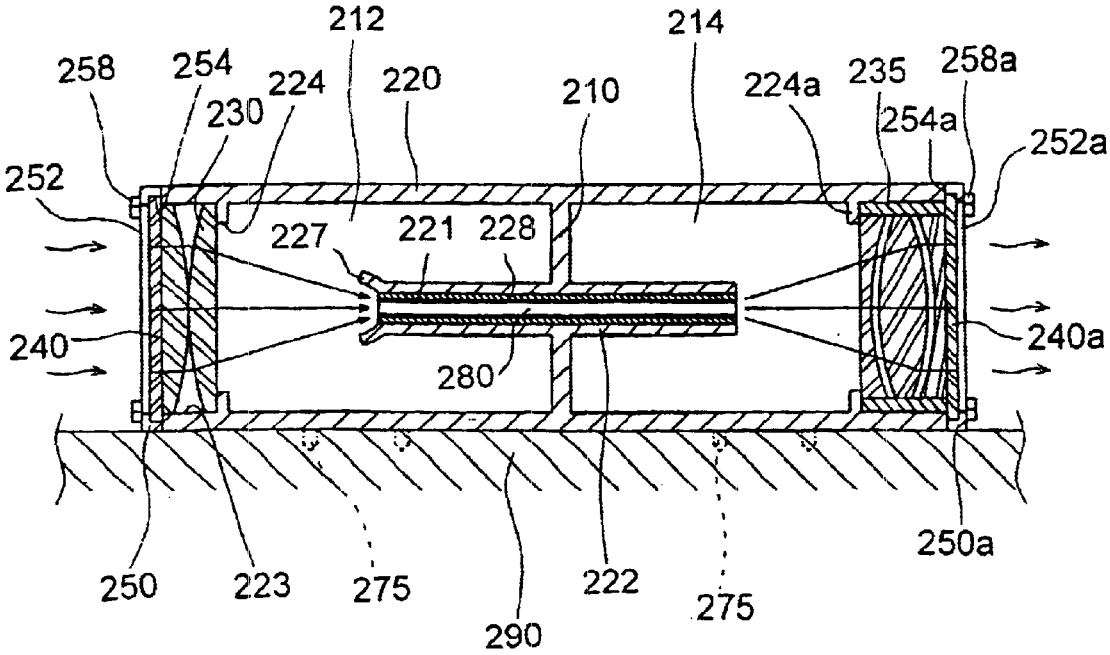
FIG. 12 is a cross-sectional view for illustrating the road indicating device in accordance with the second embodiment of the present invention.

On the other hand, FIGS. 11 and 12 are the drawings for illustrating the road indicating device in accordance with the second embodiment of the present invention, being integrally constructed with light condensing means 10, an optical cable 80 and luminous means 110.

In accordance with the second embodiment of the present invention, the road indicating device internally includes: an integral type case 220 having a fixed piece 260 fastened at the median strip 290, first and second spaces 212, 214 separated by a diaphragm 210, first and second hitching jaws 224, 224*a* formed at its both internal lateral edges and an optical cable installation part 216 penetrated through the center of the diaphragm 210 to a predetermined length; condensing lenses 230 mounted at lens accommodating surface 223 separated by a hitching jaw 254 formed inside the lateral surface of the integral case 220 for condensing light; an optical cable 280 inserted in an installation opening 221 of an optical transfer part 222 of the integral type case 220 and surrounded by a elastically supporting member 228 for transferring light condensed by the condensing lenses 230, and luminous lens 235 deposed at a lens accommodating surface 223*a* separated by a hitching jaw 254*a* formed in a lateral surface of the integral type case 220 for transforming into straight-advancing parallel light; light transmitting plates 240, 240*a* deposed in front of the condensing lenses 230 and luminous lenses 235 for protection; and pressingly fixing plates 250, 250*a* having an optical transfer opening 252 mounted for pressing and fixing the light transmitting plates 240, 240*a* with fastening screws 258, 258*a*.

Now, operations and effects of the present invention will be described in detail.

Figure 8:
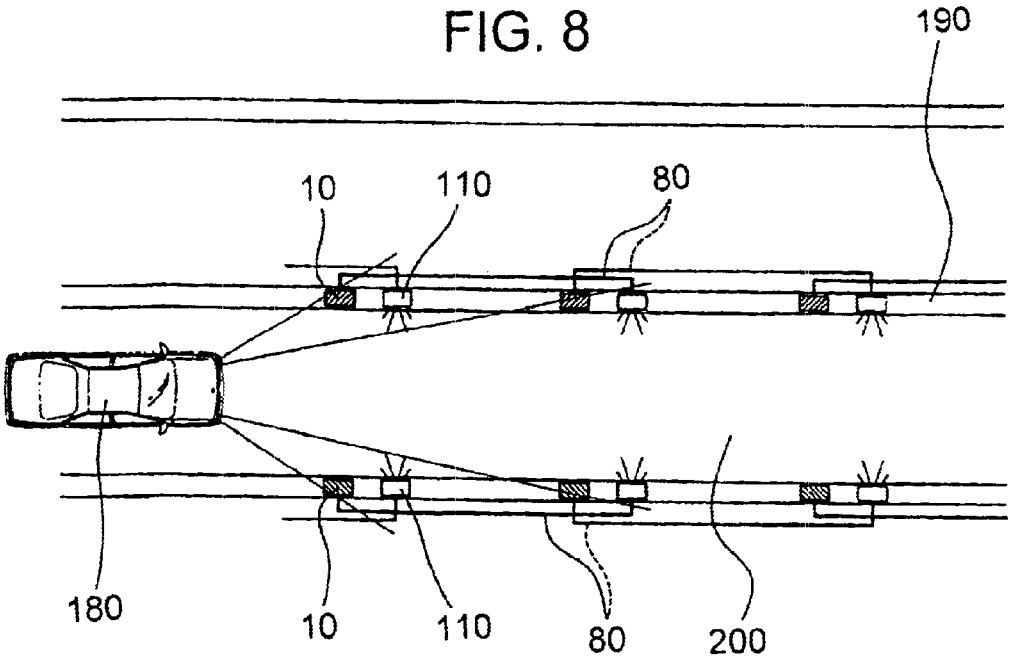
FIG. 8 is a view for illustrating a state with a short luminous distance of the road indicating device in accordance with the first embodiment of the present invention.
Figure 9:
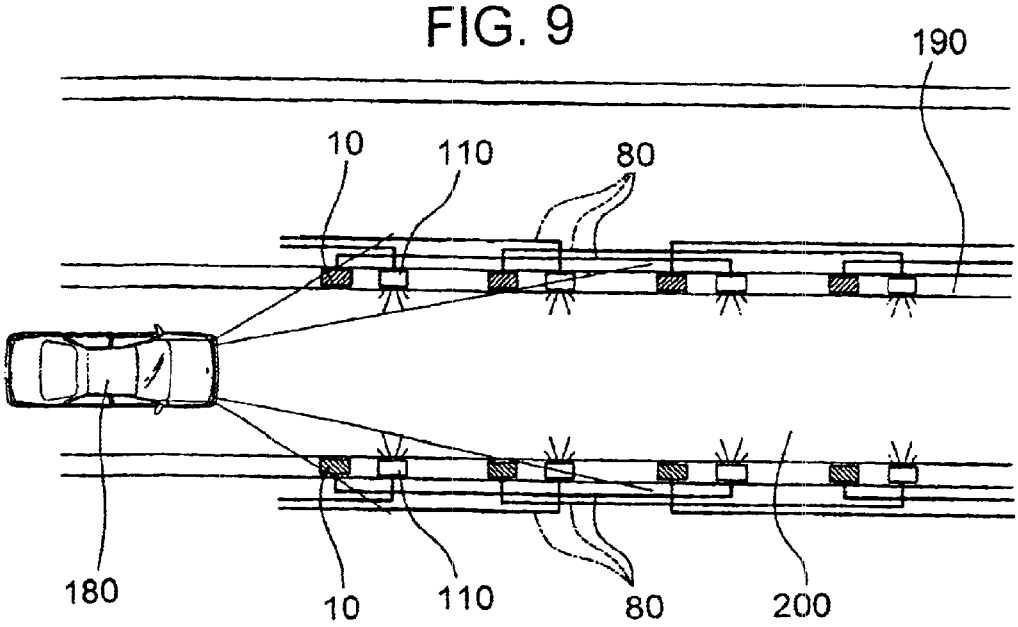
FIG. 9 is a view for illustrating a state with a long luminous distance of the road indicating device in accordance with the first embodiment of the present invention.
Figure 10:
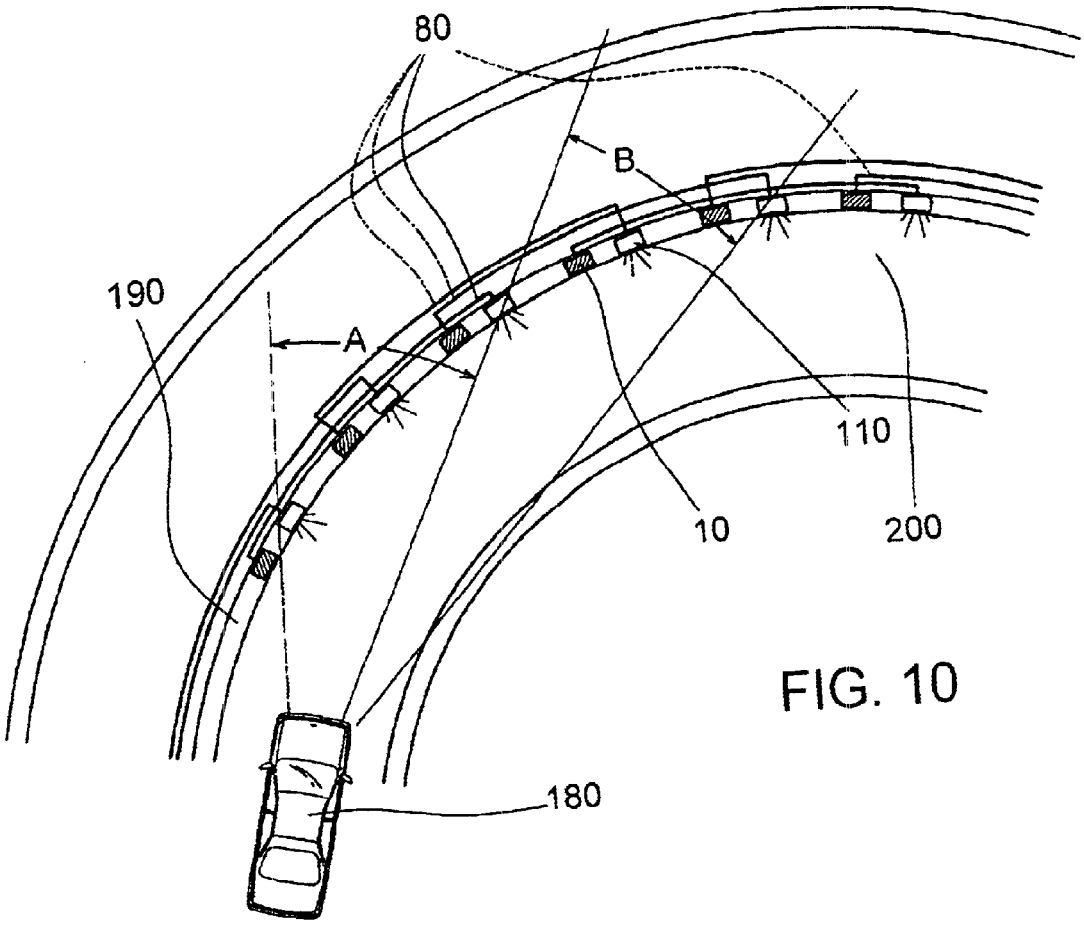
FIG. 10 is a view for illustrating a state in which the road indicating device is installed on a curved road in accordance with the first embodiment of the present invention.

FIG. 8 is a view for illustrating a state with a short luminous distance of the road indicating device in accordance with the first embodiment of the present invention, while FIG. 9 is a view for illustrating a state with a long luminous distance of the road indicating device in accordance with the first embodiment of the present invention. Furthermore, FIG. 10 is a view for illustrating a state in which the road indicating device is installed on a curved road in accordance with the first embodiment of the present invention.

At this time, the light condensing means 10 emits the light to adjacent luminous means 110 in FIG. 8, while the light condensing means 10 emits the light to the second next luminous means 110 in FIG. 9. In other words, in FIG. 8, in the point of a driver's view, light reflecting pieces have high light reflecting strength but short light reflecting distance. On the other hand, in FIG. 9, in the point of a driver's view, the light reflecting pieces have relatively low light reflecting strength but long light reflecting distance. In addition to the aforementioned methods, the road indicating device can also be applied in a variety of other manners.

Next, in accordance with the first embodiment of the present invention, FIGS. 7 and 8 illustrate the state in which the road indicating device is used. When an automobile 180 is driven on a road 200 at night, light emitted from the headlights of the automobile 180 is transmitted through the optical transfer opening 52 of the pressingly fixing plate 50, condensed through the light transmitting plate 40 by the condensing lenses 30, and transferred along the optical cable 80.

At this time, the light emitted from the optical cable 80 diffuses at a predetermined angle and proceeds to the luminous lens 130.

Furthermore, the light transferred along the optical cable 80 is transformed into straight-advancing parallel light by the luminous means 110, the luminous lens 130 mounted in the case 120, and reflected through the light transmitting plate 140 to the optical transfer opening 152 of the pressingly fixing plate 150. Therefore, the light condensed by the light condensing means 10 illuminates the road ahead, far from the automobile 180 without any change in its strength.

Thus, as shown in FIG. 10, the luminous means 110 illuminates even an area B of the road, not the area A to which the headlights of the automobile 180 can illuminate, thereby eliminating a driver's invisible zone of the road in driving. In other words, a driver's visual range is secured on the curved road to improve his safety in driving.

On the other hand, operations and effects of the road indicating device in accordance with the second embodiment of the present invention are the same as those described in accordance with the first embodiment of the present invention. In addition, in case of the integral type road indicating device according to the second embodiment of the present invention, the optical cable 280 is not exposed out for prevention from any external damage.

In addition, differently from the first embodiment of the present invention, in the second embodiment of the present invention, the light condensing means 10 and luminous means 110 are integrally formed for reduction in manufacturing cost along with convenient installation.

Figure 13:
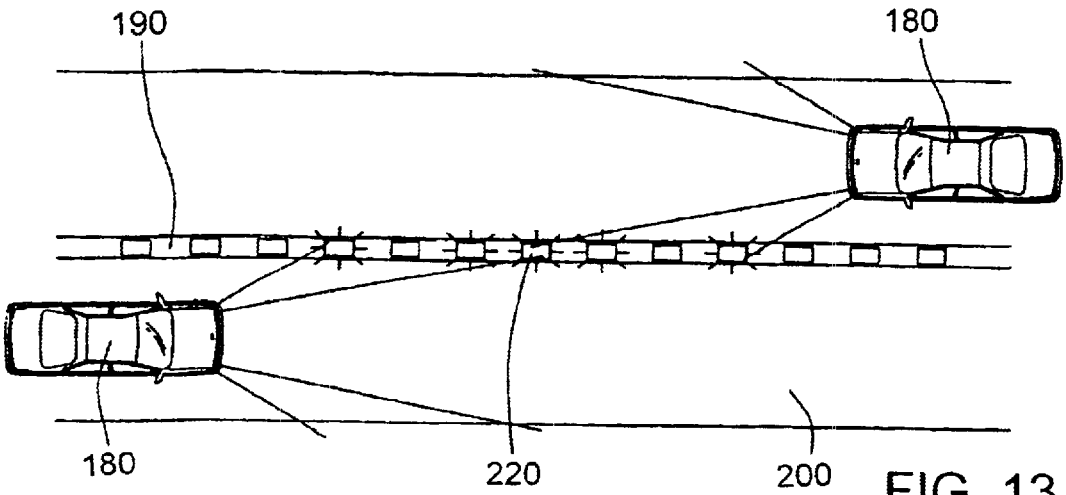
FIG. 13 is a view for illustrating a state in which the road indicating device of the second embodiment of the present invention is used.

Furthermore, as shown in FIG. 13, in the second embodiment of the present invention, the light emitted from the headlights of a driver's automobile is simultaneously illuminated to both sides of the optical cable 280 without interference, thereby making it possible to mutually take advantage of the headlights of another driver's automobile that is travelling to the opposite direction.

In other words, the condensing lens considered by a driver who is driving at a lane of the one direction plays a role as the luminous lens for another driver who is driving at another lane of the opposite travelling direction. On the other hand, the luminous lens considered by the other driver who is driving at another lane of the other travelling direction plays a role as the condensing lens for a driver who is driving at the lane of the one travelling direction. Therefore, it is possible for drivers to conveniently grasp the position of the center line from far behind.

In consequence, there are advantages in the automobile road center line indicating device of the present invention by using optical transfer in that light emitted from an automobile is condensed with convex lenses of light condensing means, transferred along an optical cable, transformed into straight-advancing parallel light with luminous means installed apart at a predetermined distance and illuminated to a long distance, where the light emitted from headlights of a driver's automobile does not reach, making it possible to recognize the position of the road center line for effectively securing a visible distance in driving to improve the driver's safety.

In addition, as the optical cable lasts almost permanently, it has an advantage of making a reduction in cost for management and re-installation regardless of its initial installation cost.

Furthermore, there is another advantage in the integral type road indicating device having integral formation of light condensing means, optical cable and luminous means in that the light emitted from the bright headlights of a driver's automobile is condensed, transferred along the optical cable, transformed into straight-advancing parallel light and illuminated to efficiently notify the center line of the road to the driver and to help another driver travelling at the next lane to the opposite direction to easily recognize the position of the road center line to thereby prevent any big traffic accident.

While the invention has been described in terms of preferred embodiments, those skilled in the art will recognize that the invention can be practiced with modification within the spirit and scope of the appended claims.

What is claimed is:

1. An automobile road center line indicating device by using optical transfer comprising:

an integral type case having a fixed piece fastened at the median strip, first and second spaces separated by a diaphragm, first and second hitching jaws formed at its both internal lateral edges and an optical cable installation part penetrated through the center of the diaphragm to a predetermined length;

condensing lenses mounted at lens accommodating surface separated by a hitching jaw formed inside the lateral surface of the integral case for condensing light;

an optical cable inserted in an installation opening of an optical transfer part of the integral type case and surrounded by a elastically supporting member for transferring the light condensed by the condensing lenses and luminous lens deposed at a lens accommodating surface separated by a hitching jaw formed in a lateral surface of the integral type case for transforming into straight-advancing parallel light;

light transmitting plates deposed in front of the condensing lenses and luminous lenses for protection; and pressingly fixing plates having an optical transfer opening mounted for pressing and fixing the light transmitting plates with fastening screws.

2. An automobile road center line indicating device by using optical transfer comprising:

light condensing means installed at road center line or border line for condensing light emitted from headlights of an automobile;

an optical cable for transferring the light condensed by the light condensing means to a predetermined position ahead from the automobile; and luminous means for transforming the light transferred along the optical cable into straight-advanced parallel light to notify a driver, wherein the light condensing means comprises:

a fixed piece for being fastened at the median strip by bottom fastening screws to be inserted through bottom side through-holes;

a case for being fastened by lateral side fastening screws through lateral through-holes formed at a perpendicularly angled part of the fixed piece and lateral through-holes of the case in connection with an optical cable and an optical transfer part being formed in parallel to the center;

condensing lenses installed at a lens accommodating surface separated by a hitching jaw of the optical transfer part of the case for transforming the light transferred into straight-advancing parallel light;

a light transmitting plate deposed in front of the condensing lenses for protection; and a pressingly fixing plate having an optical transfer opening mounted for pressing and fastening the light transmitting plate through front through-holes of the case with front fastening screws inserted into through-holes.

3. An automobile road center line indicating device by using optical transfer comprising:

light condensing means installed at road center line or border line for condensing light emitted from headlights of an automobile;

an optical cable for transferring the light condensed by the light condensing means to a predetermined position ahead from the automobile; and luminous means for transforming the light transferred along the optical cable into straight-advanced parallel light to notify a driver, wherein the luminous means includes:

a fixed piece for being fastened at the median strip by bottom fastening screws to be inserted through bottom through-holes;

a case for being fastened by lateral fastening screws through lateral through-holes formed at a perpendicularly angled part of the fixed piece and lateral through-holes of the case in connection with an optical cable and an optical transfer part being formed in parallel to the center;

a luminous lenses installed at a lens accommodating surface separated by a hitching jaw from the optical transfer part of the case for transforming into straight-advancing parallel light;

and a light transmitting plate deposed in front of the luminous lenses for protection; and a pressingly fixing plate having an optical transfer opening mounted for pressing and fastening the light transmitting plate through front through-holes of the case with front fastening screws inserted into through-holes.

* * * * *